US007195564B2

(12) United States Patent
Han

(10) Patent No.: US 7,195,564 B2
(45) Date of Patent: Mar. 27, 2007

(54) GOLF BALL FOR PUTTING PRACTICE

(76) Inventor: Taek-Sun Han, 24 Bristol Dr., Manhasset, NY (US) 11030

( * ) Notice: Subject to any disclaimer, the term of this patent is extended or adjusted under 35 U.S.C. 154(b) by 86 days.

(21) Appl. No.: 10/696,876

(22) Filed: Oct. 30, 2003

(65) Prior Publication Data

US 2005/0043118 A1 Feb. 24, 2005

(30) Foreign Application Priority Data

Aug. 21, 2003 (KR) ..... 10-2003-0058025

(51) Int. Cl.
*A63B 69/36* (2006.01)
*A63B 37/60* (2006.01)

(52) U.S. Cl. ..... 473/280; 473/351

(58) Field of Classification Search ..... 473/280–284, 473/371, 377, 378, 383, 384, 613, 200, 351
See application file for complete search history.

(56) References Cited

U.S. PATENT DOCUMENTS 2,135,210 A * 11/1938 Farrar ..... 473/383
3,819,190 A * 6/1974 Nepela et al. ..... 473/383
4,284,276 A * 8/1981 Worst ..... 473/383
4,345,759 A * 8/1982 Nims ..... 473/569
4,706,958 A * 11/1987 Inoue ..... 473/268
5,054,153 A * 10/1991 Silliman ..... 15/160
5,556,342 A * 9/1996 Berberian ..... 473/125
5,759,109 A * 6/1998 Martini ..... 473/200
6,852,039 B2 * 2/2005 Pettigrew et al. ..... 473/280
2003/0158002 A1 * 8/2003 Morgan et al. ..... 473/383
2004/0005937 A1 * 1/2004 Saiz ..... 473/351

FOREIGN PATENT DOCUMENTS

JP 52-46946 4/1977
JP 60-195062 12/1985

* cited by examiner

*Primary Examiner*—Nini F. Legesse
(74) *Attorney, Agent, or Firm*—Jordan and Hamburg LLP

(57) ABSTRACT

In a golf ball having a plurality of dimples, a groove having a certain width and depth is formed on a surface of the golf ball, the depth of the groove extending below the surface. A belt having a certain width and height may be formed on a surface of the golf ball, the height of the belt extending above the surface. It is possible to implement an efficient putting practice where a groove or belt is formed on a surface of a golf ball to affect the rolling and movement of the golf ball. The width of the groove or belt may be changed, so that a user selects a certain golf ball based on his practice level. A certain number or symbol may be formed on the groove or belt, so that a user can select a golf ball for practice based on his ability level.

8 Claims, 6 Drawing Sheets

GOLF BALL FOR PUTTING PRACTICE

BACKGROUND OF THE INVENTION

1. Field of the Invention

The present invention relates to a golf ball for a putting practice, and in particular to an improved golf ball for a putting practice in which a golf ball rolls and is moved in a desired direction by forming a concave groove or convex belt on a spherical surface of a golf ball.

2. Description of the Background Art

As shown in FIG. 2, a groove represents a concave portion formed in a spherical surface of a golf ball and having a certain width and depth, and as shown in FIG. 12 a belt represents a convex portion formed a spherical surface of the same and having a certain width and height.

Researches have been performed for many years for changing a size, depth and arrangement of the dimples formed on a surface of a golf ball for implementing a desired hydrodynamic property.

FIG. 1 is a perspective view illustrating a conventional golf ball. As shown in FIG. 1, the golf ball 1 has a plurality of dimples formed on a surface 2 of the same at a certain interval therebetween for thereby implementing a desired hydrodynamic property. When a golf practice player puts a golf ball, the golf ball rolls based on a putting force and putting angle and a state of a practice field and then is moved into a hole. The putting practice is directed to straightly rolling a golf ball in a direction of a hole. The golf ball may be rolled and moved in various directions based on the condition of the practice field. Therefore, in order to test and enhance a player's ability, the golf ball must be rolled and moved in a desired direction when practicing the golf ball. At this time, the players practice the putting using a golf ball which is generally used in an actual golf field.

However, in the conventional art, it is impossible for a practice player to select a certain golf ball based on his ability and to select the same based on his advanced ability.

SUMMARY OF THE INVENTION

Accordingly, it is an object of the present invention to provide a golf ball for a putting practice which overcomes the problems encountered in the conventional art.

It is another object of the present invention to provide a golf ball for a putting practice in which a golf ball is rolled and moved in a desired direction by forming a groove or belt having a certain width and formed on a spherical surface of a golf ball.

It is further another object of the present invention to provide a golf ball for a putting practice in which a practice player is capable of selecting a certain golf ball based on his ability and is capable of selecting a certain golf based on his advanced ability.

To achieve the above objects, in a spherical golf ball having a plurality of dimples on a surface of the same, a groove having a certain width and a certain depth lower than a surface of a golf ball or a belt having a certain width and a certain height higher than a surface of a golf ball is formed on a spherical surface of a golf ball. The width of the groove or belt is ¼ of the diameter R of a golf ball, and the depth of the golf ball is ⅛ of the diameter R of the golf ball. The width of the belt is ¼ of the diameter R of the golf ball, and the height of the belt is ⅛ of the golf ball.

The width of the groove is ⅓ of the diameter R of the golf ball, ⅙ R or ⅛ R. The width of the groove is not limited to the values disclosed herein. Namely, the width of the groove may be changed to ⅖ R or ⅜ R based on the material of the golf ball, the user's play ability and style. In addition, the width of the belt may be ⅓, ⅙ or ⅛.

In the present invention, the most important point is that the weight of the golf ball is the same as the weight of a golf ball which is actually used in the field. Namely, the weight of the golf ball is neither higher nor lower than the standard weight of the golf ball. The golf ball for a putting practice has the same condition as the golf ball which is actually used in the field. The method for fabricating the golf ball may be implemented by the conventional method. The method for fabricating the golf ball according to the present invention includes a step for forming a core of a golf ball in such a manner that the weight of the entire golf ball is the same as a golf ball which is actually used in the field, a step for forming a groove on a surface of the golf ball, said groove having a certain width, and a step for adhering the surface of the golf ball having the groove with the core. The method for fabricating a golf ball is implemented based on a conventional fabrication process, provided that in order to implement the same weight, the surface of the golf ball is grooved by ⅛ of the diameter of the golf ball for thereby forming a desired groove having a certain width (preferably ¼ R). At this time, the weight of the grooved golf ball is decreased by the grooved degree. Therefore, it is needed to supplement the weight by the grooved degree.

The golf ball according to the present invention may be formed in a single structure, namely, in a single piece using a proper rubber or a plastic composition or may be formed in two pieces of a single structure or may have a core of multiple structures in which the core is surrounded by a protection layer. The surface, groove or belt of the golf ball may be formed of balata, qutta percha, synthesis trans-polyisobutylene, polyurethanes, or polyethylene and a mixture of the above materials which are generally used in a single material. The forming method may be implemented based on a conventional forming method. For example, two semi-spherical balls may be first formed, and then the core is compressed and molded or the golf ball may be injection-molded in a single piece.

In the step for forming a groove or belt, a golf ball mold having a certain mold surface for implementing a groove shape or belt shape is provided in the conventional manner. The golf ball having a groove or belt is painted in the conventional method. As another method, the compositions used may be properly mixed each other for thereby omitting a painting step.

The step for forming the groove may further have a step for forming a certain logo, number, symbol, etc. on the groove. A certain logo, number, or symbol is formed on the surface of the golf ball, and a golf player checks the number or logo of the golf ball and plays golf. In addition, the player putts, aiming at the logo of the golf ball using his hand on the green.

However, in the conventional art, it is impossible for a user to check his putting level or to check whether his ability is being advanced. As one feature of the present invention, as the width of the groove is narrower, the probability that the golf ball rolls and is moved straightly is higher than that of the golf ball having a wider width. Therefore, a certain advertisement logo or number is printed on the surface of the groove in such a manner that the numbers are formed in a sequence of 1, 2, 3, 4, 5 . . . from the narrow width to the wider width. Namely, the practice golf ball of D=¼ R is given 1, the golf ball of D=⅓ R is given 2, and D=⅙ R is given 3, and D=⅛ R is given 4. Therefore, when the user selects the number 4, it is recognized that the user is a high level player.

Namely, a beginner uses a practice golf ball having a wider groove and then changes to the golf ball having a narrower width. The advanced user selects the golf ball having a larger number formed on the surface of the groove. Therefore, in the present invention, it is possible for the user to check whether his ability is advanced or not.

Finally, the user selects the golf ball having a narrowest width. At this time, since the above golf ball is very similar to the golf ball which is actually used in the field, the user's ability is gradually enhanced.

BRIEF DESCRIPTION OF THE DRAWINGS

The present invention will become better understood with reference to the accompanying drawings which are given only by way of illustration and thus are not limitative of the present invention, wherein.

DETAILED DESCRIPTION OF THE PREFERRED EMBODIMENTS

The preferred embodiments of the present invention will be described with reference to the accompanying drawings.

Figure 1:
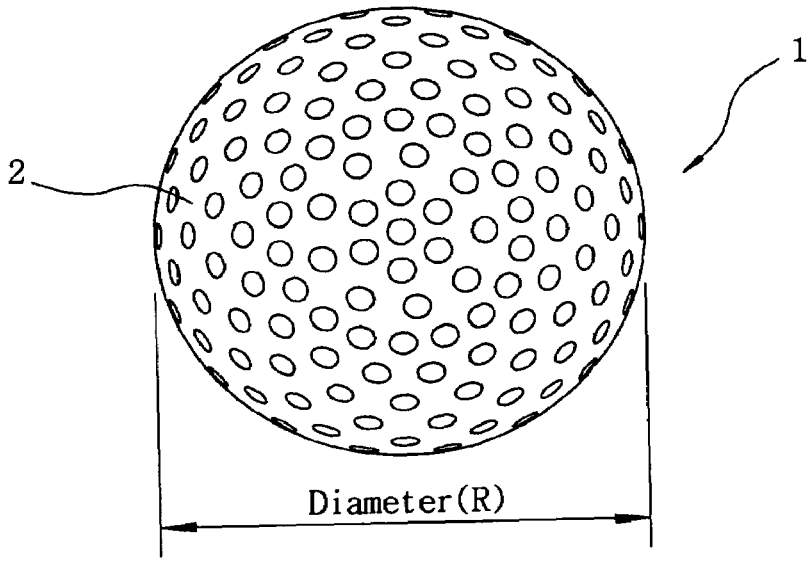
FIG. 1 is a perspective view illustrating a conventional golf ball.
Figure 2A:
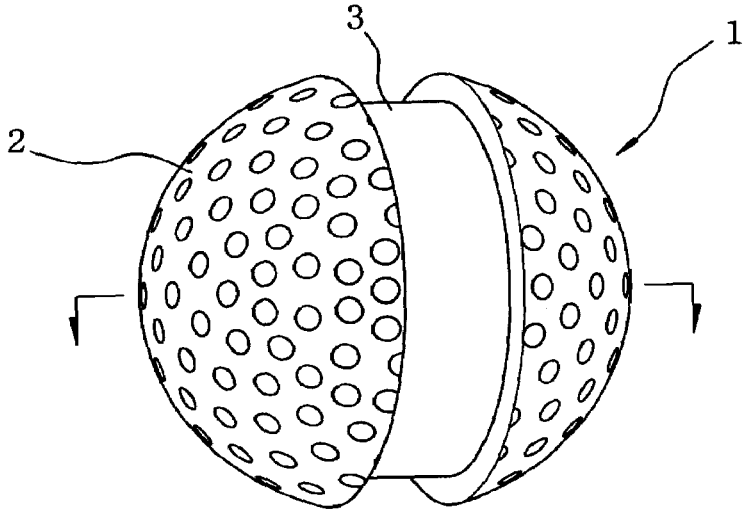
FIG. 2A is a perspective view illustrating a golf ball having a groove according to the present invention.
Figure 2B:
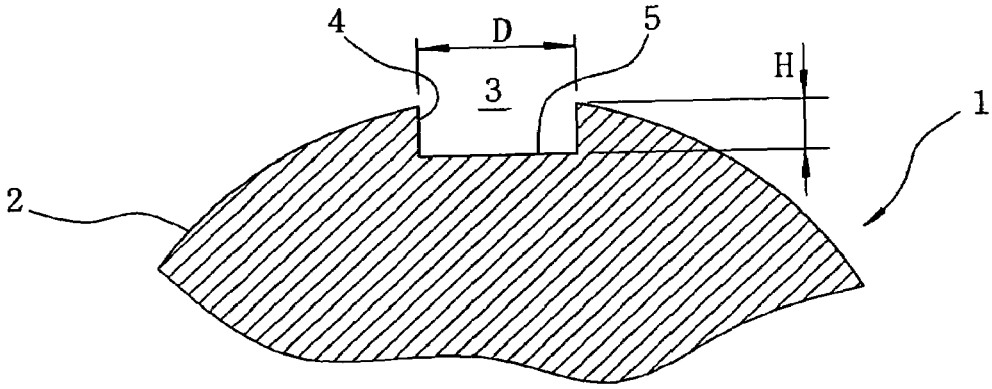
FIG. 2B is a cross sectional view of FIG. 2A.
Figure 3:
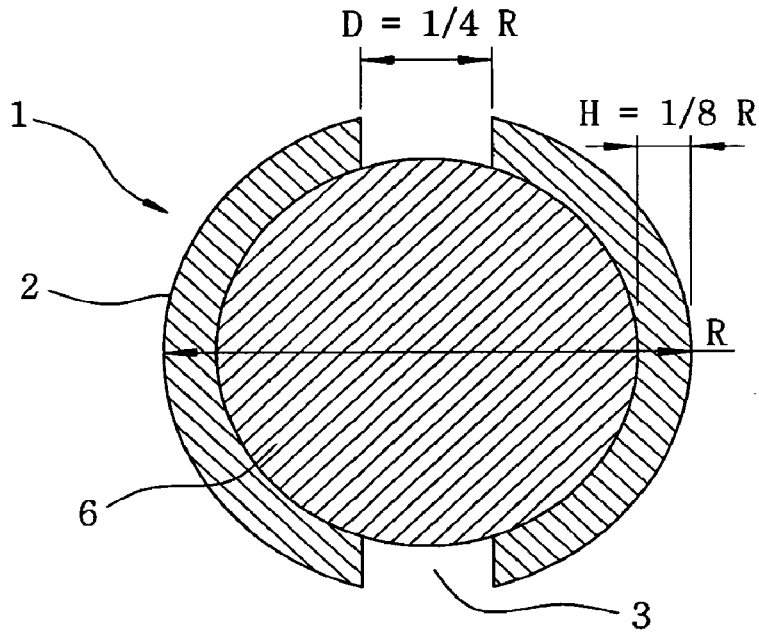
FIG. 3 is a cross sectional view illustrating a golf ball in which a width of a groove is ¼ R according to the present invention.

FIG. 2A is a perspective view illustrating a golf ball having a groove according to the present invention, FIG. 2B is a cross sectional view of FIG. 2A, and FIG. 3 is a cross sectional view illustrating a golf ball in which a width of a groove is ¼ R according to the present invention.

Figure 4:
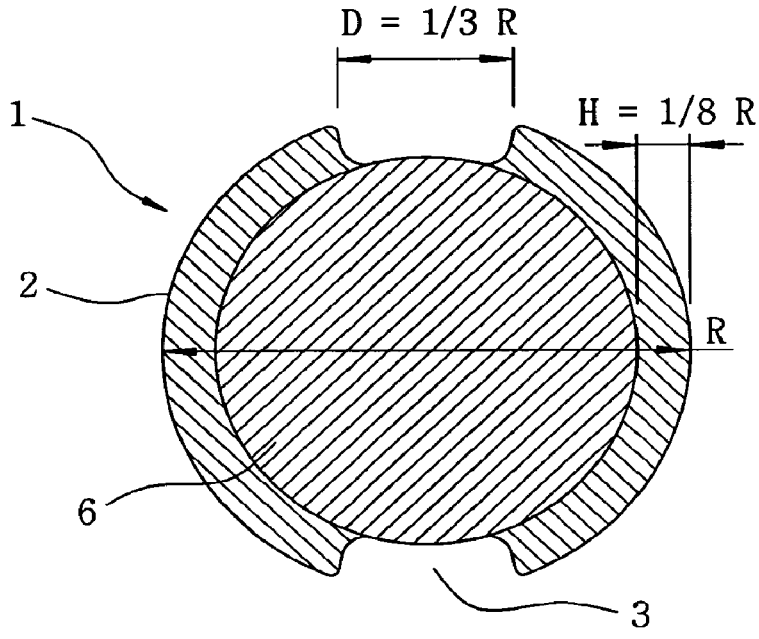
FIG. 4 is a cross sectional view illustrating a golf ball in which a width of a groove is ⅓ R according to the present invention.

As shown in FIGS. 2A and 2B, a golf ball 1 has a groove 2 formed on a surface 2 of the golf ball 1 and having a certain depth lower than the surface 2 of the same. A width D of the groove 3 is ¼ a radiator of the golf ball, and the depth H of the groove is ⅛ of the diameter R of the golf ball. The shape of the wall 4 of the groove may be regular angle or may be rounded as shown in FIG. 4. The bottom of the groove 3 may be formed of regularly arranged dimples or may be formed flat.

Figure 5:
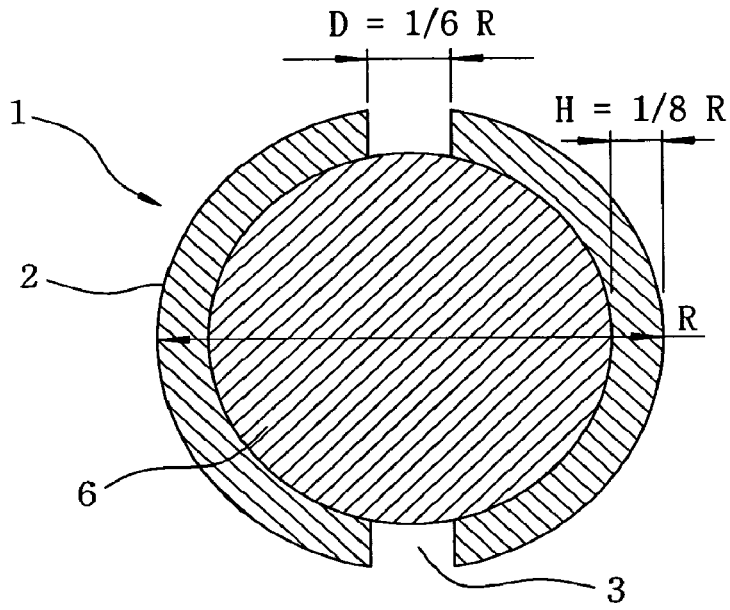
FIG. 5 is a cross sectional view illustrating a golf ball in which a width of a groove is ⅙ R according to the present invention.
Figure 6:
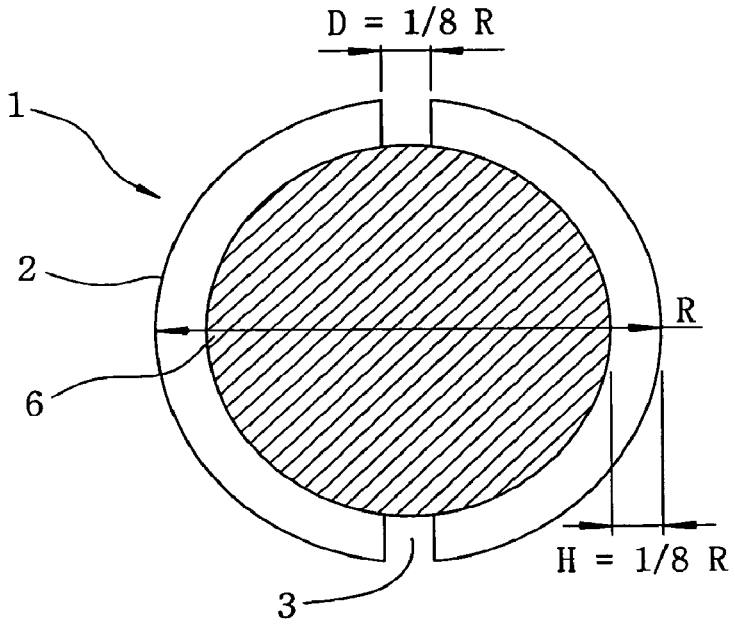
FIG. 6 is a cross sectional view illustrating a golf ball in which a width of a groove is ⅛ R according to the present invention.

FIG. 4 is a view illustrating the construction that the width of the groove is ⅓ R, and the wall of the groove is rounded, and FIG. 5 is a view illustrating the construction that the width of the groove is ⅙ R, and FIG. 6 is a cross sectional view illustrating the construction that the width of the groove is ⅛ R.

Namely, as shown in FIG. 4, H=⅛ R, and D=⅓ R, and as shown in FIG. 5, H=⅛ R, D=⅙ R, and as shown in FIG. 6, h=⅛ R, and D=⅛ R. The width D of the bottom 5 of the groove may have various values.

Figure 7:
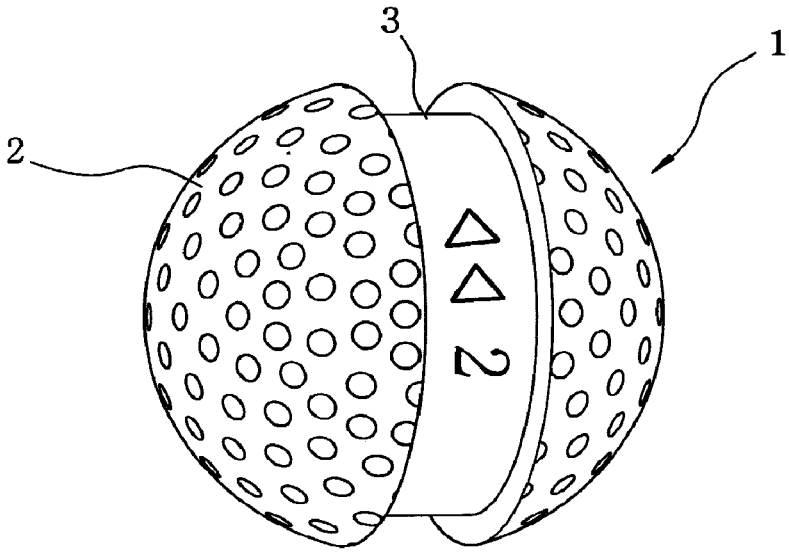
FIG. 7 is a view illustrating a golf ball having a certain number and symbol in a groove according to the present invention.

FIG. 7 is a cross sectional view illustrating the construction that numbers and symbols are formed in the groove of the golf ball according to the present invention. A certain logo, slogan, number, etc. may be printed on the surface of the groove. As shown in FIG. 7, the symbols ◁◁◁and the number 2 are formed. Here, 2 represents a golf ball for practice and H=⅛ R, and D=⅓ R.

Figure 8:
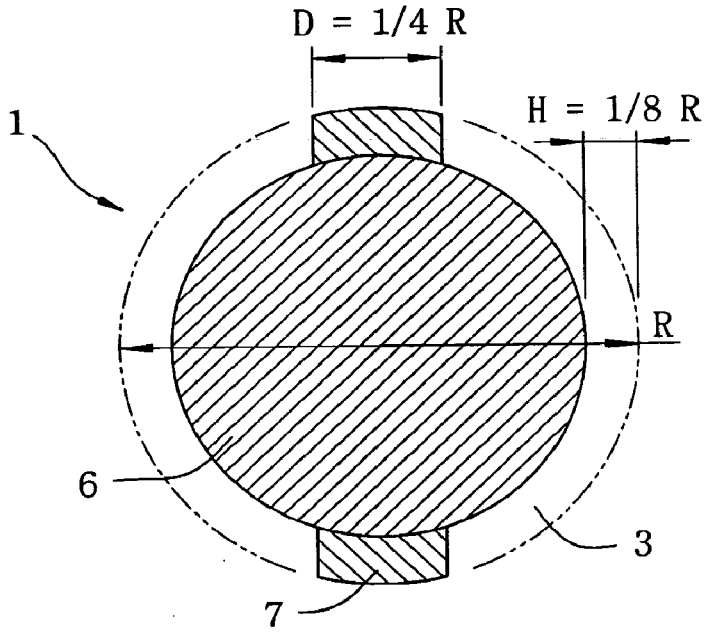
FIG. 8 is a cross sectional view illustrating a golf ball in which a width of a belt is ¼ R according to the present invention.
Figure 9:
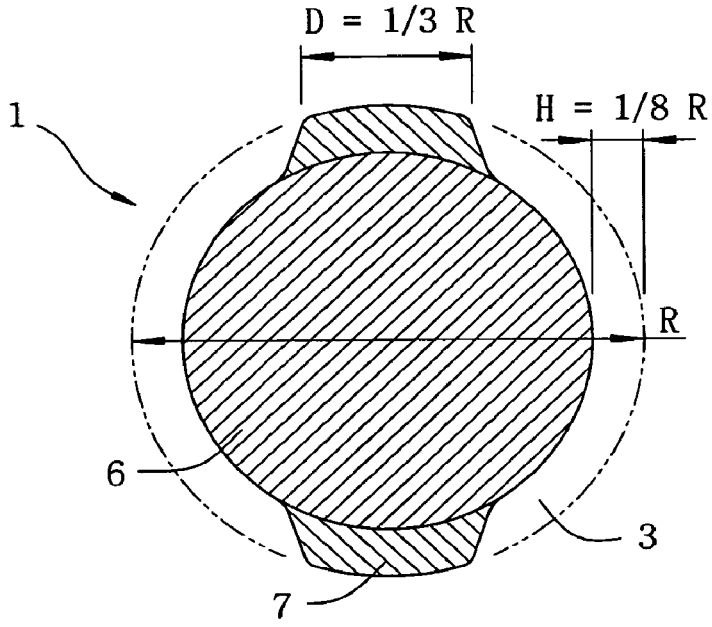
FIG. 9 is a cross sectional view illustrating a golf ball in which a width of a belt is ⅓ R according to the present invention.
Figure 10:
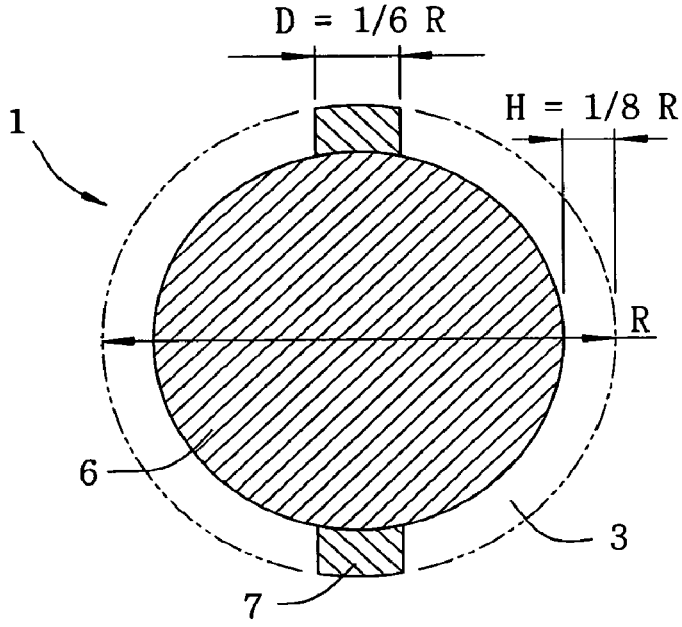
FIG. 10 is a cross sectional view illustrating a golf ball in which a width of a belt is ⅙ R according to the present invention.
Figure 11:
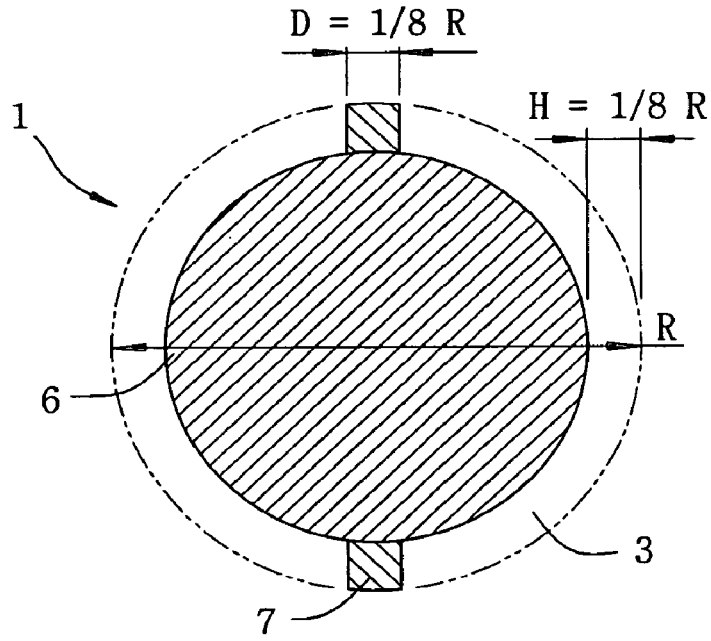
FIG. 11 is a cross sectional view illustrating a golf ball in which a width of a belt is ⅛ R according to the present invention.
Figure 12:
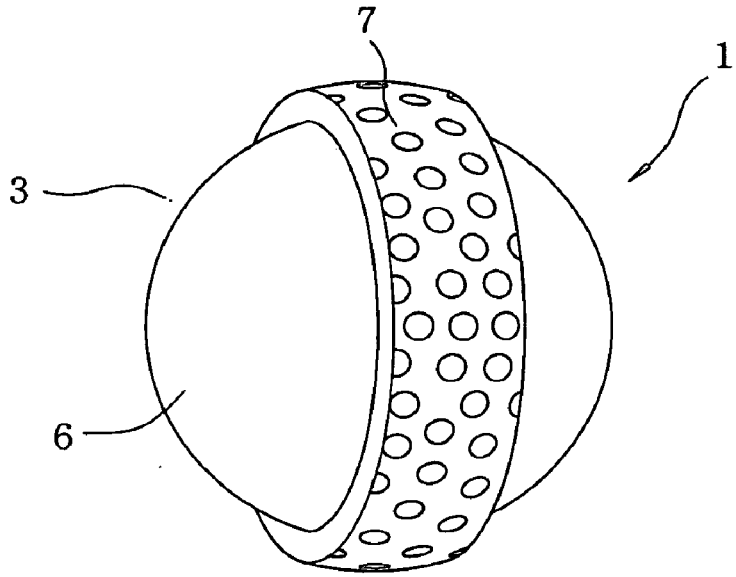
FIG. 12 is a perspective view illustrating a golf ball having a belt according to the present invention.

In addition, in another embodiment of the present invention, a belt 7 may be formed in the golf ball in such a manner that the height of the belt 7 has slightly higher than the surface 2 of the golf ball. FIG. 8 is a cross sectional view illustrating that the width of the belt is ¼ of the diameter R of the golf ball, and as shown in FIG. 9, the width of the belt is ⅓ R, and as shown in FIG. 10, the width of the belt is ⅙ R, and as shown in FIG. 11, the width of the belt is ⅛ R. FIG. 12 is a perspective view illustrating the construction that a belt is formed on the surface of the golf ball according to the present invention. As shown in FIGS. 8 through 12, the belt 7 are protruded from the surface 2 of the golf ball compared to the groove concaved in the earlier embodiment of the present invention, so that the golf ball is rolled based on the belt. Here, the widths of the belts may have different values. In the preferred embodiments of the present invention, the widths of the belts may be ¼ of the diameter R of the golf ball, ⅓ R, ⅛ R, and ⅙ R like the grooves of the earlier embodiment of the present invention. The wall surface of the belt 7 may be a regular angle, and as shown in FIG. 9, the wall surface of the same may be rounded.

Since the construction, operation and fabrication method of the belt of the present invention is the same as those of the groove of the earlier embodiment of the present invention, the detailed descriptions thereof will be omitted.

As described above, in the present invention, a groove having a certain width and certain depth is formed on a spherical surface of a golf ball or a belt having a certain width and certain height is formed on a spherical surface of a golf ball. The weight of the golf ball according to the present invention is the same as the golf ball which is actually used in the field, so that it is possible to enhance a golf player's ability during a golf putting practice.

In the present invention, a certain groove having a certain width and depth or a certain belt having a certain width and height is formed on a spherical surface of a golf ball for thereby forming a reference line in a golf ball, so that it is possible to implement an efficient putting practice.

In addition, in the present invention, it is possible to differently form grooves and belts on a spherical surface of a golf ball, so that a user can select a golf ball based on his practice level. Since a certain number or symbol is formed in a groove or belt of a golf ball based on a user's practice level, a user can select a golf ball based on his practice level.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

What is claimed is:

1. A golf ball for putting practice comprising; a plurality of dimples on a surface of said golf ball; and a groove formed on said surface of said golf ball and completely circumscribing said golf ball, said groove having a width selected among ⅓, ¼, and ⅛ of a diameter of said golf ball and a depth of ⅛ of a diameter of said golf ball.

2. The golf ball of claim 1, further comprising at least one selected from a logo, number, symbol, and slogan printed on said groove.

3. The golf ball of claim 2, wherein said at least one selected from a logo, number, symbol, and slogan is seen when said golf ball rolls during use of said golf ball.

4. The golf ball of claim 2, wherein said at least one selected from a logo, number, symbol, and slogan is indicative of the width of said groove.

5. The golf ball of claim 2, wherein said at least one selected from a logo, number, symbol, and slogan corresponds to a skill level of a golf player.

6. The golf ball according to claim 2, wherein said groove has spaced sides, said groove defining a central plane disposed equidistant from said spaced sides and which intersects a center of said golf ball.

7. The golf ball according to claim 2, wherein said groove is the only groove formed on said surface of said golf ball which circumscribes said golf ball.

8. A golf ball comprising:

a groove; and at least one selected from a logo, number, symbol, and slogan primed on said groove and being indicative of a width of said groove, wherein the width of said groove is from ⅛ to ¼ of a diameter of said golf ball.

* * * * *